United States Patent [19]

Fournier et al.

[11] Patent Number: 4,809,645

[45] Date of Patent: Mar. 7, 1989

[54] DEVICE FOR SHIELDING BOILER BAFFLES, IN PARTICULAR FOR REFUSE INCINERATOR FURNACES, AND A METHOD FOR THE CONSTRUCTON OF SAID DEVICE

[75] Inventors: Jean Fournier, Rochefort en Yvelines; Adrian Casariego, Velizy Villacoublay, both of France

[73] Assignee: Stein Industrie, Velizy Villacoublay, France

[21] Appl. No.: 160,804

[22] Filed: Feb. 26, 1988

[30] Foreign Application Priority Data

Feb. 27, 1987 [FR] France ..... 87 02673

[51] Int. Cl.[4] ..... F22B 37/00

[52] U.S. Cl. ..... 122/6 A; 29/157.4; 110/336; 110/338; 110/339; 122/DIG. 13

[58] Field of Search ..... 122/6 A, DIG. 13; 110/334, 338, 339; 29/157.4

[56] References Cited

U.S. PATENT DOCUMENTS 3,828,735 8/1974 Graham et al. ..... 122/6 A
3,850,146 11/1974 Graham et al. ..... 122/6 A

FOREIGN PATENT DOCUMENTS 504273 7/1976 Australia .
0228918 7/1987 European Pat. Off. .
2495284 6/1982 France .
561814 6/1944 United Kingdom .

*Primary Examiner*—Edward G. Favors
*Attorney, Agent, or Firm*—Sughrue, Mion, Zinn, Macpeak, and Seas

[57] ABSTRACT

Vertical tubes joined to each other by means of welded coupling fins and forming boiler baffles for refuse incinerators are placed between refractory bricks and provided with vertical auxiliary anchoring fins which make an angle of 30° to 60° with the plane of the coupling fins and are interrupted at intervals over vertical sections of the tubes. One portion of the bricks is provided with vertical recesses corresponding to the auxiliary fins over a fraction of their height from the bottom and the other portion of the bricks is provided with vertical recesses up to their full height. The bricks of the first portion are anchored to the top portion of the auxiliary fins and the bricks of the other portion are engaged on these fins above a brick of the first portion.

10 Claims, 4 Drawing Sheets

DEVICE FOR SHIELDING BOILER BAFFLES, IN PARTICULAR FOR REFUSE INCINERATOR FURNACES, AND A METHOD FOR THE CONSTRUCTON OF SAID DEVICE

BACKGROUND OF THE INVENTION

1. Field of the Invention

This invention relates to a device for shielding the baffles of waste-heat boilers and in particular for refuse incinerator furnaces, said baffles being formed of vertical tubes joined to each other by means of welded coupling fins, said tubes being disposed behind refractory bricks and provided with means for anchoring the refractory bricks. The scope of the invention includes a method of construction of said device.

2. Description of the Prior Art

In boilers of the most recent types having baffles obtained by longitudinal welding of fins between adjacent tubes, it has been proposed in particular in French patent No. FR-A-2495284 to fix the refractory shielding bricks whose function is to provide protection against the very hot corrosive combustion gases by welding on each tube several series of arms extending at right angles to the plane of the coupling fins and having a horizontal axis, the bricks being then anchored to the arms.

However, these arms extended to a distance from the tubes and were therefore inadequately cooled, with the result that they were fairly rapidly destroyed by oxidation. Thus the brick-supporting system became progressively unserviceable, in particular in the bottom portion of the hearth located immediately above the incinerator kiln . Repair or reconstruction of a tube shielding system of this type involved long periods of shutdown of boilers and very high costs.

The object of the present invention is to provide a device which has the function of shielding the baffles of boilers of this type, which is not subject to progressive destruction by oxidation of inadequately cooled metal parts, which consequently offers a long service life, but which is nevertheless of simple structural design and easy to manufacture.

SUMMARY OF THE INVENTION

The device in accordance with the invention is distinguished by the fact that the means for anchoring the bricks are vertical auxiliary fins which make an angle between 30° and 60° with the plane of the coupling fins, that the auxiliary fins are interrupted at intervals over vertical sections of the tubes, that a first portion of the refractory bricks is provided with vertical recesses which correspond to the auxiliary fins both in width and in thickness but extend from the bottom upwards only to a fraction of their height whereas the other portion of said refractory bricks is provided with vertical recesses which extend to their full height, and that the bricks of the first portion are anchored to the upper portion of the auxiliary fins and the bricks of the other portion are engaged on said auxiliary fins above a brick of said first portion.

The device preferably conforms to at least one of the following characteristics:

The auxiliary fins make an angle of approximately 45° with the plane of the coupling fins.

The width of the auxiliary fins is at most equal to one-half of the width of the coupling fins located between the tubes, thereby ensuring that said auxiliary fins are maintained at a low temperature.

The vertical recesses of the first portion of the refractory bricks extend upwards from the bottom to one-half of their height.

The refractory bricks are also rigidly assembled by means of vertical cylindrical refractory rods adapted to engage in vertical grooves formed in said bricks in an external zone remote from the tube-coupling fins.

The refractory bricks are rigidly assembled by means of horizontal cylindrical refractory rods adapted to engage in horizontal grooves formed in the external zone of said bricks.

The method of construction in accordance with the invention for a device of this type is distinguished by the fact that a longitudinal fin is welded between pairs of tubes and interrupted at intervals over a fraction of its height, that the fin connecting each pair is cut at the center, thus forming an auxiliary fin of small width on each tube, that the elementary tubes are disposed in parallel relation in a plane, the auxiliary fins being inclined at an angle between 30° and 60° with respect to said plane and being oriented towards each other, that the tubes are joined to each other by means of coupling fins welded between adjacent tubes, that a refractory brick is engaged on the upper portion of a pair of auxiliary fins, said refractory brick being provided with vertical recesses which correspond to those of the auxiliary fins both in width and in thickness and which extend only over a fraction of their height from the bottom upwards, that at least one other refractory brick provided with vertical recesses extending to its full height is engaged on the pair of auxiliary fins above the first refractory brick and that the operation is repeated up to the full height of the tubes.

Welding of the initial longitudinal fins to the pairs of tubes and subsequent welding of coupling fins between the tubes are preferably performed by means of an automatic consumable-wire welding machine.

Advantageously, the bricks are rigidly secured to each other by engaging vertical cylindrical refractory rods in oppositely-facing vertical grooves formed in said bricks in an external zone remote from the tube-coupling fins and if necessary by engaging horizontal cylindrical refractory rods in oppositely-facing horizontal grooves formed in said bricks in an external zone remote from said tube-coupling fins.

DESCRIPTION OF THE PREFERRED EMBODIMENTS

Figure 1:
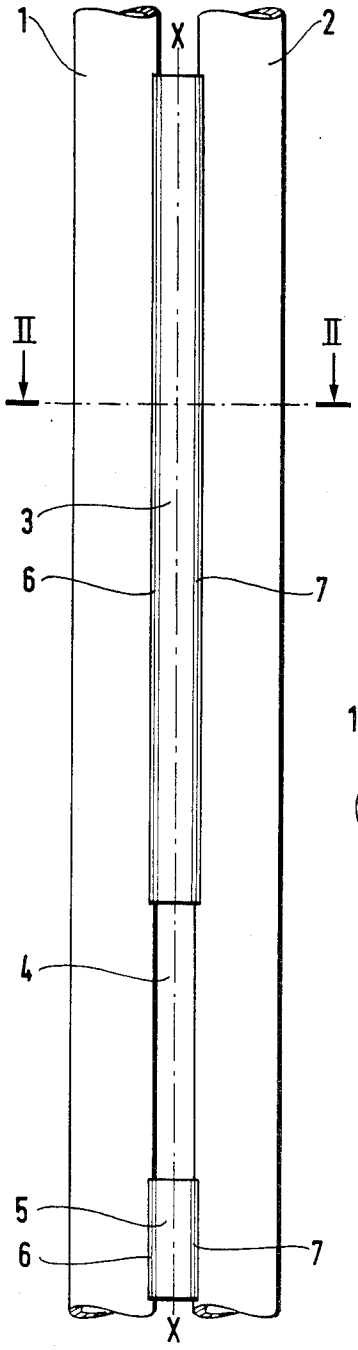
FIG. 1 illustrates a pair of tubes after a fin interrupted at uniform intervals over the height of said tubes has been welded between these latter at the beginning of construction of the shielding device.
Figure 2:
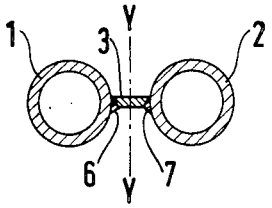
FIG. 2 illustrates the same pair of tubes, this view being taken in cross-section along line II—II of FIG. 1.

For the construction of a boiler baffle, the initial step consists in forming pairs of tubes joined together by means of welded fins having, for example, a width of 38 mm and a height of 750 mm, and interrupted at intervals of 1000 mm over a length of 250 mm, as shown in FIGS. 1 and 2. These fins are welded by means of an automatic machine of known type such as the consumable welding wire type which ensures a high and constant quality of weld.

The fins which connect the two tubes of each pair are then cut at the center along the axes X—X of FIG. 1 and Y—Y of FIG. 2. There are therefore obtained individual tubes provided with short fins having a height of 750 mm with intervals of 250 mm between the fins.

Figure 3:
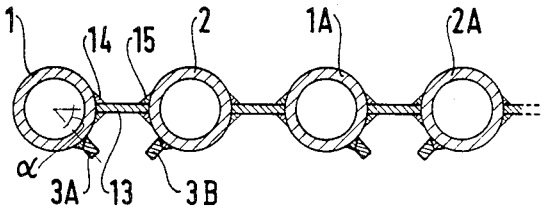
FIG. 3 is a sectional view taken along a horizontal plane and showing adjacent tubes joined together by means of coupling fins and each provided with an auxiliary fin for anchoring refractory bricks.

These tubes are arranged side by side in pairs such as the pairs 1, 2; 1A, 2A in which the short fins of two tubes of each pair are directed towards each other and make with the plane of the axes of the tubes an angle $\alpha$ having a value between 30° and 60° and preferably in the vicinity of 45° as shown in FIG. 3. Panels are then formed by interconnecting the tubes by means of fins 13 welded to the tubes by means of weld fillets such as the filets 14, 15. These welds are also made by means of an automatic machine which ensures a high and constant quality of weld.

Since it is of small size (smaller in width than the external diameter of the tubes), this fin 13 is very efficiently cooled by the fluid which circulates within the tube.

Protection of the tubes against corrosive hot gases is ensured by means of bricks of refractory material having a silicon carbide base, for example. These bricks are of two types hereinafter designated as "type A" and "type B", are shown in elevation and in plan in FIGS. 4, 5, 6 and 7, and are shown in greater detail, associated with the corresponding tubes, in elevation in FIG. 8 and in cross-section in FIG. 9.

Figure 4:
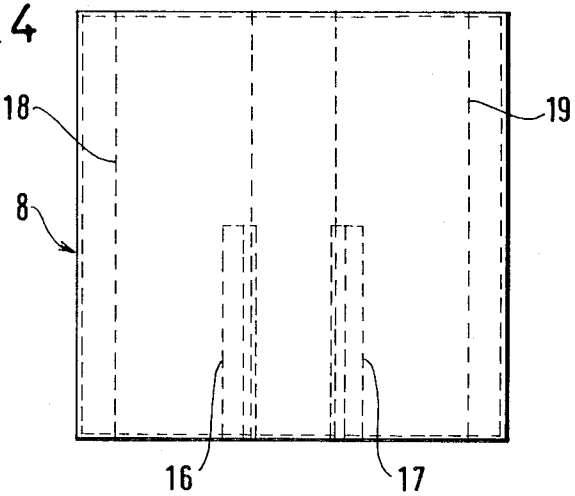
FIG. 4 is a view in elevation showing a brick of the first type or so-called "type-A brick" provided with a partial vertical recess.
Figure 5:
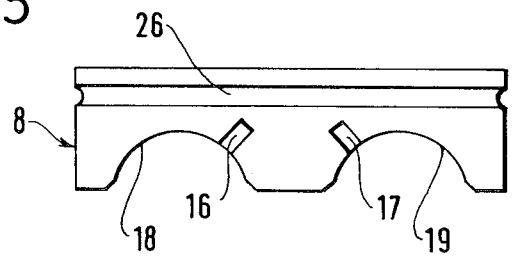
FIG. 5 is an overhead plan view after reversal of the same brick.

The type-A bricks illustrated in FIGS. 4 and 5 are provided with vertical recesses 16, 17 which are slightly larger in width and in depth than the thickness and width of the short fins, and which extend over the lower half of their height. Said bricks also have cylindrical channels 18, 19, the radius of which is slightly longer than the radius of the tubes.

Figure 6:
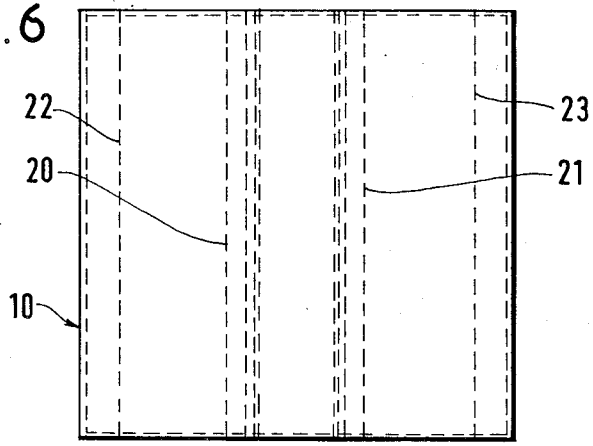
FIG. 6 is a view in elevation showing a brick of the second type or so-called "type-B brick" having a vertical recess extending to its full height.
Figure 7:
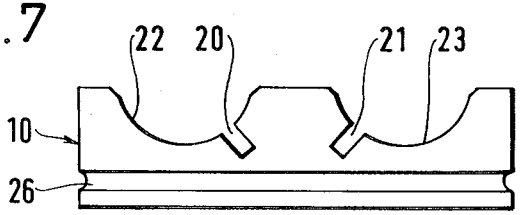
FIG. 7 is a bottom plan view of the same brick.

The type-B bricks illustrated in FIGS. 6 and 7 are provided with vertical recesses 20, 21 which are slightly larger in width and in depth than the thickness and width of the short fins, thus corresponding to the recesses of the type-A bricks but extending in this case to the full height of the brick. The radius of their cylindrical channels 22, 23 corresponds to the radius of the tubes.

Figure 8:
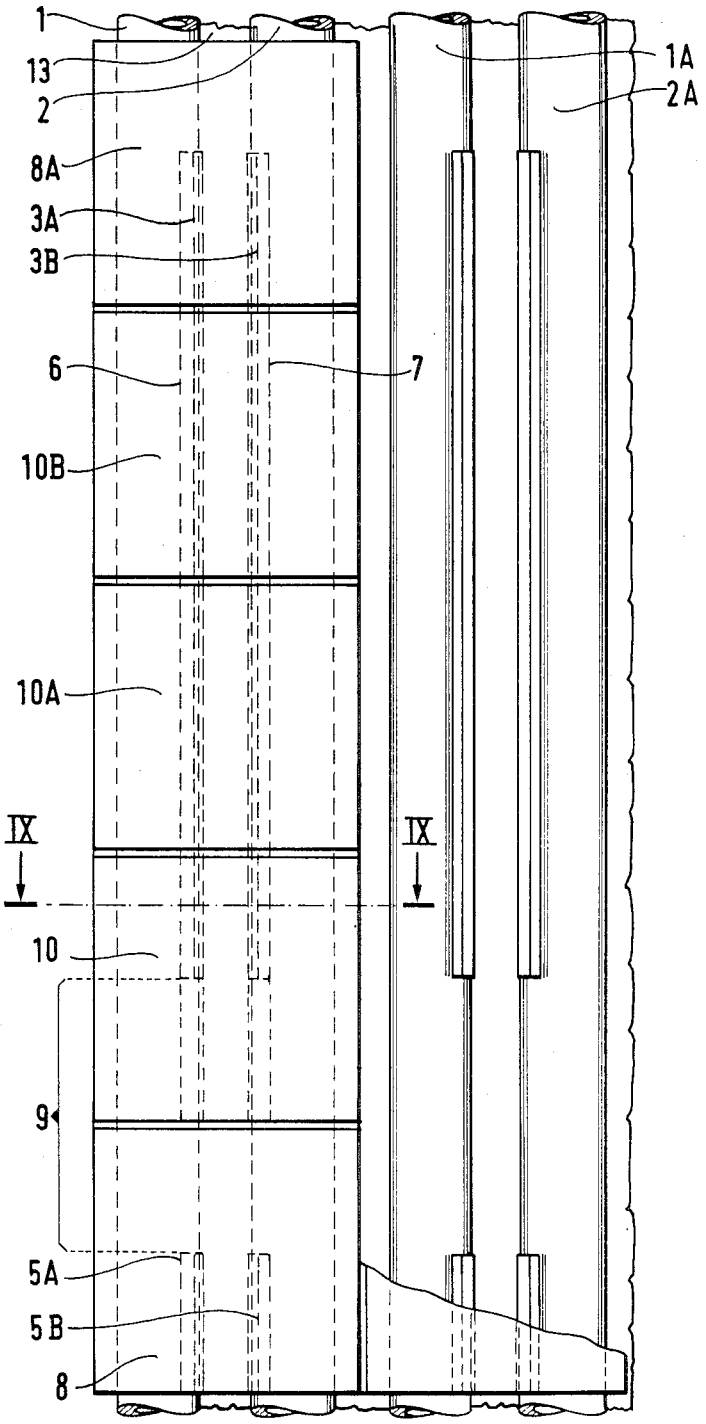
FIG. 8 is a fragmentary view in elevation showing adjacent tubes fitted with their shielding bricks.

In order to constitute the refractory shield of the tube baffle, a type-A brick 8 is inserted through the opening located between two short ribs (opening 9 of FIG. 8).

These bricks bear on the top ends of the short fins 5A, 5B. Through the opening located above the short fins 3A, 3B are successively inserted type-B bricks such as three bricks 10, 11, 12, for example. A type-A brick 8A is then inserted through the same opening, and so on in sequence.

Figure 9:
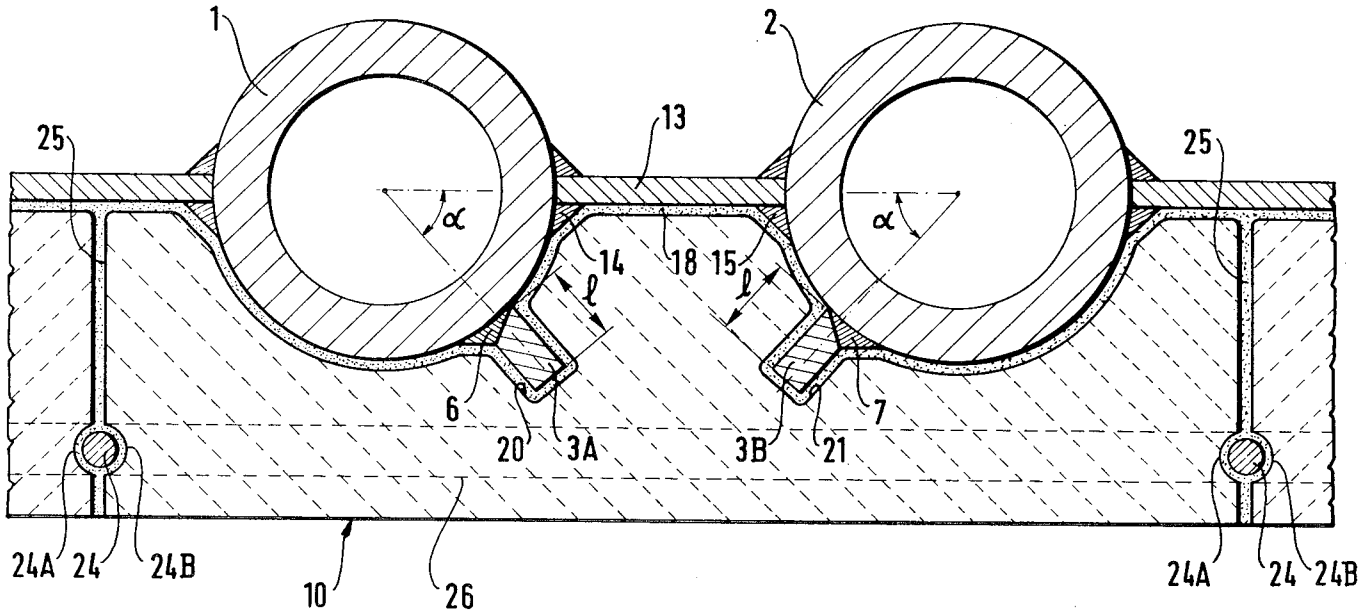
FIG. 9 is a partial sectional view to a larger scale showing a shielding baffle provided with its shielding bricks and vertical rods for rigidly assembling its bricks.

FIG. 9 shows in greater detail a completed shield element. The width 1 of the short fins 3A, 3B fitted within the recesses such as 20, 21 of the opposite brick is preferably in the vicinity of one-half the width of the fins 13 connecting adjacent tubes, with the result that they remain at a low temperature (below 450° C.). Two adjacent bricks are rigidly coupled together by means of vertical rods of refractory material such as the rods 24 which are inserted in the oppositely-facing grooves 24A, 24B of the bricks. Although not illustrated, horizontal coupling rods can be added to the vertical rods. A refractory cement slurry 25 is injected in order to ensure an effective bond between the bricks and between the baffle and the bricks and in order to prevent any passage of smoke along the baffle.

What is claimed is:

1. A device for shielding the baffles of waste-heat boilers and in particular for refuse incinerator furnaces, said baffles being formed of vertical tubes which are joined to each other by means of welded coupling fins and are disposed behind refractory bricks, anchoring means for anchoring said refractory bricks to said tubes, wherein said anchoring means are vertical auxiliary fins welded to said tubes and making an angle between 30° and 60° with the plane of the coupling fins, wherein the auxiliary fins are interrupted at intervals over vertical sections of the tubes, wherein a first portion of said refractory bricks is provided with vertical recesses which correspond to the auxiliary fins both in width and in thickness but extend from the bottom upwards only to a fraction of their height and wherein another portion of said refractory bricks is provided with vertical recesses which extend to their full height, and wherein the bricks of the first portion are anchored to the upper portion of the auxiliary fins and the bricks of the other portion engage said auxiliary fins above a brick of said first portion.

2. A device according to claim 1, wherein the auxiliary fins make an angle of approximately 45° with the plane of the coupling fins.

3. A device according to claim 1, wherein the width of the auxiliary fins is at most equal to one-half of the width of the coupling fins located between the tubes, thereby ensuring that said auxiliary fins are maintained at a low temperature.

4. A device according to claim 1, wherein the vertical recesses of the first portion of the refractory bricks extends upwards from the bottom to about one-half of their overall height.

5. A device according to claim 1, wherein the refractory bricks are also rigidly assembled by means of vertical cylindrical refractory rods engaged in vertical grooves formed in said bricks in an external zone remote from the tube-coupling fins.

6. A device according to claim 5, wherein the refractory bricks are rigidly assembled by means of horizontal cylindrical refractory rods engaged in horizontal grooves formed in the external zone of said bricks.

7. A method of construction of a device for shielding boiler baffles for refuse incinerator furnaces, comprising the steps of welding a longitudinal fin between pairs of tubes, interrupted at intervals over a fraction of its height, cutting the fin connecting each pair at the center so as to form an auxiliary fin of small width on each tube, disposing the tubes in parallel relation in a plane, with the auxiliary fins inclined at an angle between 30° and 60° with respect to said plane and oriented towards each other, joining the tubes to each other by means of coupling fins welded between adjacent tubes, engaging a refractory brick on the upper portion of a pair of auxiliary fins, providing said refractory brick with vertical recesses which correspond in width and in depth to the thickness and the width of the auxiliary fins and which extend only over a fraction of their height from the bottom upwards, and engaging at least one other refractory brick provided with vertical recesses extending to its full height on the pair of auxiliary fins above the first refractory brick and repeating the operation up to the full height of the tubes.

8. A method according to claim 7, wherein said step of welding of the initial longitudinal fins to the pairs of tubes and subsequent welding of coupling fins between the tubes comprises welding by means of an automatic consumable-wire welding machine.

9. A method according to claim 7, wherein the bricks are rigidly secured to each other by engaging vertical cylindrical refractory rods in oppositely-facing vertical grooves formed in said bricks in an external zone remote from the tube-coupling fins.

10. A method according to claim 9, wherein the bricks are rigidly secured to each other by engaging horizontal cylindrical refractory rods in an external zone remote from said tube-coupling fins.

* * * * *